US006268022B1

(12) United States Patent
Schlegel et al.

(10) Patent No.: US 6,268,022 B1
(45) Date of Patent: Jul. 31, 2001

(54) PROCESS FOR COATING CABINET DOORS

(75) Inventors: Grant E. Schlegel, Macungie; Gregory R. Mill, Womelsdorf; Paul R. Horinka, West Lawn, all of PA (US)

(73) Assignee: Morton International, Inc., Chicago, IL (US)

( * ) Notice: Subject to any disclaimer, the term of this patent is extended or adjusted under 35 U.S.C. 154(b) by 0 days.

(21) Appl. No.: 09/390,486

(22) Filed: Sep. 3, 1999

(51) Int. Cl.[7] ..... B05D 1/04

(52) U.S. Cl. ..... 427/471; 427/475; 427/485; 427/317; 427/393

(58) Field of Search ..... 427/467, 469, 427/471, 475, 485, 317, 392, 393, 397

(56) References Cited

U.S. PATENT DOCUMENTS 5,721,052 * 2/1998 Muthiah et al. .

FOREIGN PATENT DOCUMENTS 933 140 * 4/1999 (EP) .

OTHER PUBLICATIONS

"Powder Coating: The Complete Finisher's Handbook", pp. 88–98, First Edition, Ed by Nicholas P. Liberto, 1994.*

* cited by examiner

*Primary Examiner*—Fred J. Parker

(57) ABSTRACT

Machine-profiled edges and corners and other surface discontinuities of heat sensitive workpieces such as wooden cabinet doors are uniformly covered by a coating powder applied electrostatically to the back side of the workpiece first, allowing the powder to wrap around the edges toward the front side, and then applying the coating powder electrostatically to the front side and fusing or fusing/curing the coating powder.

9 Claims, 2 Drawing Sheets

PROCESS FOR COATING CABINET DOORS

This invention is directed to a method for electrostatically applying a coating powder to a heat-sensitive substrate such as wood and particularly fiberboard, and fusing or fusing/curing the applied coating powder to form a continuous coating. In particular, the invention is directed to an electrostatic method for completely coating edges and corners of workpieces to a uniform thickness.

BACKGROUND OF THE INVENTION

A frequent problem encountered when coating low-temperature substrates, such as wood, with coating powder is non-uniformity of coating in areas of the substrate which are difficult to coat, such as the edges and corners of kitchen cabinet doors. A frequently observed defect at edges, corners and other surface discontinuities is a rough, non-uniform finish. Surface moisture on wood provides a mechanism for the electrostatic coating of the otherwise non-conductive substrate, particularly when the substrate is grounded. The Faraday cage effect, the self limiting coating thickness and the ability of the powder to follow electrostatic field lines and wrap around edges, all typical electrostatic coating effects, are all found when wood is electrostatically coated at room temperature. Preheating of the wood to the powder fusing temperature defeats the self limiting mechanism so that thicknesses of 5 mils or more are achieved. Some improvement in Faraday penetration is also seen and the wrap around phenomenon is unchanged.

When a wooden substrate, e.g., medium density fiberboard or MDF, is machined into a complex part such as a cabinet door, a groove routed within the field of the door's front surface tends to exhibit problems of incomplete coverage that may be associated with the Faraday effect. Other machined areas of the door which seemingly should be easy to coat electrostatically, such as the outside edges which make up the perimeter of the door, also pose problems which make complete coverage very difficult. Because the thinned areas of the machined door surface tend to lose heat from the pre-heated door more rapidly than the areas of original thickness, the outside edges and corners become the most difficult to coat properly.

For example, the front side (or A side) of a cabinet door made from one piece of medium density fiberboard typically is routed along its perimeter to help give the visual appearance of a traditional "5 piece" natural wood cabinet door. The profile of this perimeter routing (the classical Ogee, for example) depends upon the selection of the proper router bit but it always results in a declining step shape, a portion of which is thinner than the original edge. Coating these thinner portions first from the front side before much heat is lost would be the logical approach but the result is unsatisfactory.

SUMMARY OF THE INVENTION

The invention is generally directed to heat-sensitive substrates having edges, corners, or other surface discontinuities. The heat-sensitive substrates are exemplified by certain plastics and fibrous lignocellulosic materials whether derived from trees or other plants and whether such material is in its natural state or its fibers have been separated, felted and/or compressed. Thus, lignocellulosic material includes hardboard, medium and high density fiber board, particle board, oriented strand board, cardboard, and paper. High- or medium-density fiberboard is generally substantially more dense adjacent to the surfaces than in interior regions.

Typically, in the pre-pressed fiber preparation, three fiber layers are provided with outer layers more dense than the core layer, thereby providing surface toughness while reducing weight at the core. When such fiberboard is cut into workpieces, such as for kitchen cabinet doors, the less dense core layer is exposed. Rough, non-uniform finishes result when the coating soaks into the less dense areas.

The method of this invention is particularly adapted to the electrostatic powder coating of workpieces having complex parts such as sharp edges around the perimeter of the piece or grooves within the field thereof such as for cabinet doors. Workpieces having low density parts or flat stock having a profiled edge such as table tops, desk tops, and shelving are also amenable to this coating method.

Accordingly, it is a general object of the present invention to provide an electrostatic method for completely coating edges and corners of a heat-sensitive workpiece with a thermosettable or thermoplastic coating powder and fusing or fuse/curing the powder to form a film having a substantially uniform thickness.

This and other objects of the invention which will become apparent from the following description and drawings are accomplished by a method comprising the steps of preheating a heat-sensitive workpiece having a front side (the A side) and a back side (the B side) to achieve a surface temperature of from about 230° to about 260° F., said front side in turn having a field portion and edge portions bordering the field portion, electrostatically spraying a coating powder onto the B side first and allowing the powder to wrap around the edge portions to cover them and a portion of the A side, then electrostatically spraying a coating powder onto the A side, fusing the powder to form a film, and curing a thermosetting film or cooling a thermoplastic film.

Coating of a routed groove in the field of a cabinet door, for example, before the back side is coated may be carried out by any satisfactory method known to the coating art but an electrostatic spraying of a coating powder onto the heated front side with a gun having a pinpoint nozzle, such as is available from ITW GEMA, is preferred. The coating path follows the groove with limited overspray providing less than 50% coverage of the adjacent flat area.

As was said above, moisture is advantageous for electrostatic application of coating powder in that it enables the otherwise non-conductive material to transfer sufficient electrical charge for efficient electrostatic coating powder application. The moisture content of the wood or other heat-sensitive lignocellulosic substrate for the purposes of this invention is from about 3 to about 10 wt %. The moisture on the surface of a plastic substrate for the purposes of this invention is from about 0 to about 1% by weight.

For the purposes of this invention, the term "powder coated" means electrostatically powder coated and it applies to both the fused and non-fused powder and to a cured powder coating as the context requires.

DETAILED DESCRIPTION OF THE INVENTION

Figure 1:
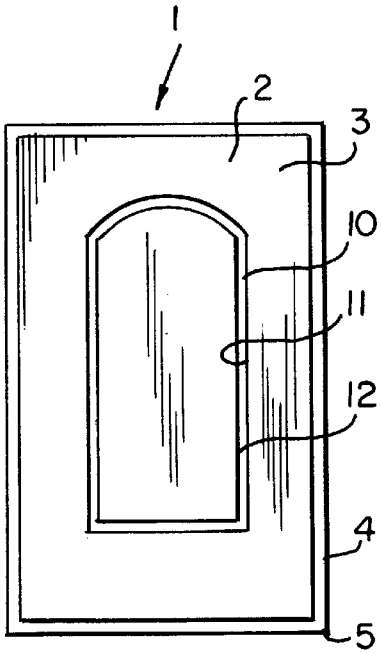
FIG. 1 is a plan view of the front side or face of a kitchen cabinet door having a routed groove within the field of said face.
Figure 2:
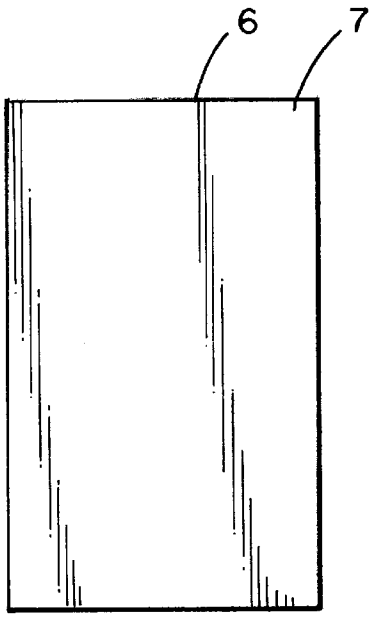
FIG. 2 is a plan view of the back side of the kitchen cabinet door of FIG. 1.
Figure 3:
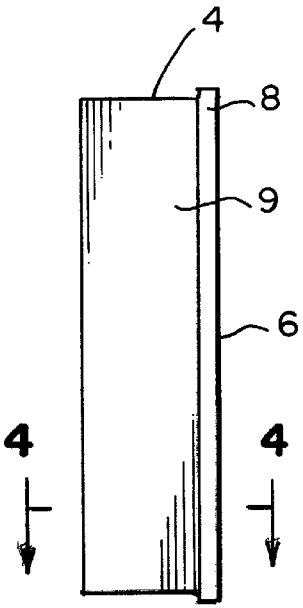
FIG. 3 is an end view of the door of FIGS. 1 and 2.
Figure 4:
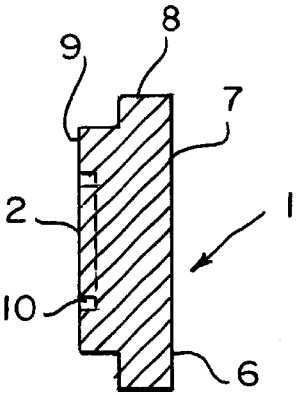
FIG. 4 is a cross-sectional view of the door taken along line 4—4 of FIG. 3.
Figure 8:
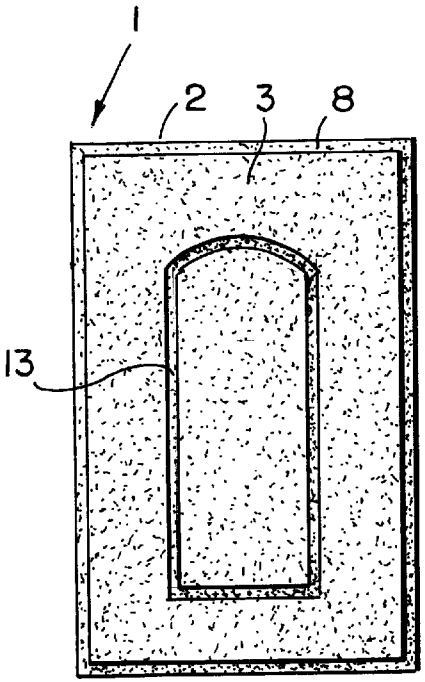
FIG. 8 is a plan view of the fully powder coated face of the door of FIG. 1.

Illustrated in FIGS. 1–8 is the workpiece 1 in the form of a one-piece kitchen cabinet door made from medium density fiberboard (hereinafter MDF). Workpiece 1 is rectangular, having the front side 2 or face (the A side) consisting of the field 3, the machined edges 4, and the corners 5. The planar back side 6 (the B side) of the workpiece 1, as illustrated in FIG. 2, comprises the field 7. As shown in FIG. 4, the profile of the machined edge is step-shaped, the lips 8 of the edges and corners being adjacent the back side and boss 9 being adjacent the front side. The routed groove 10 in the field has an outer edge 11 and an inner edge 12. The coated surfaces are indicated by stippling.

Figure 7:
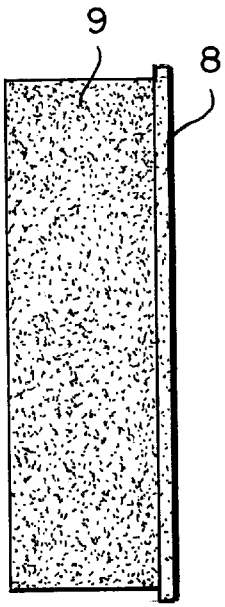
FIG. 7 is an end view of the door of FIG. 6.
Figure 6:
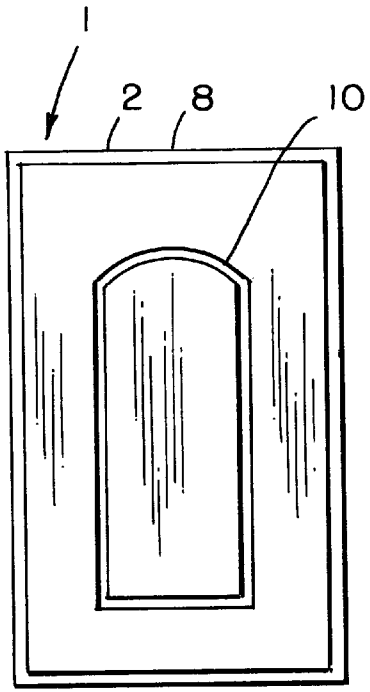
FIG. 6 is a plan view of the face of the door of FIG. 1 after powder coating the back side.
Figure 5:
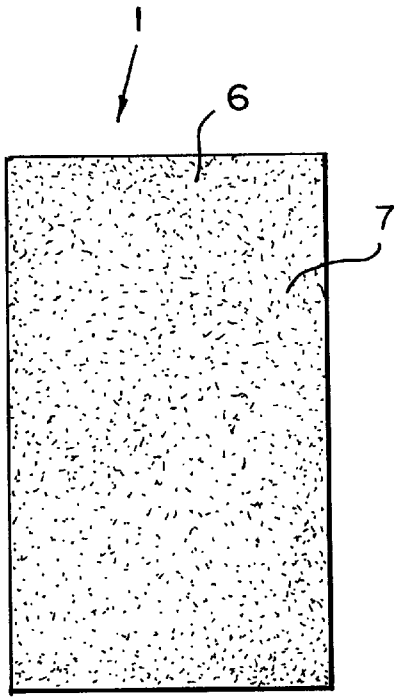
FIG. 5 is a plan view of the powder coated back side of the door of FIG. 1.

The workpiece is preheated in a convection oven set at a temperature in the range of 350–450° F. for about 10–20 minutes to achieve a surface temperature of about 230–260° F. and moved to the first spray gun within about 30 to 60 seconds so that, prior to the coating of the backside 6 of the workpiece, the surface is still at about 230–240° F. while the routed groove 10 is powder coated first with an electrostatic spray gun having a pinpoint nozzle. For the sake of convenience, the coated groove 13 is shown only in FIG. 8. The back side 6 (the B side) of the workpiece is then passed through the flat spray pattern of a coating powder from a slotted, fan-shaped nozzle attached to an electrostatic gun. No special attention to the perimeter is necessary as the powder flows around to the front side 2 (the A side), partially coating the lips 8 and fully coating the boss 9, as shown in FIG. 7. The powder coating is completed by directing the flat spray pattern of powder from a slotted, fan-shaped nozzle of a second electrostatic gun toward the A side, again with no need to follow the contours of the piece. This final coating step provides a uniform coverage of side A and eliminates the often troubling phenomenon of picture framing. It also completes the coverage of the lips 8 of the edges 4 and corners 5.

When the coating powder is thermoplastic, the thus coated workpiece is simply set aside to cool before it is handled further as, for example, being attached to a cabinet. When the workpiece is covered with a themosetting powder coating, however, it is then placed in an oven maintained at about 325–425° F., preferably from 325 to 375° F., until the coating is cured. Preferably, the surface temperature of the workpiece before placement in the oven is 140° F. or higher to avoid the hotter and/or longer cycles. Typically, the dwell time in the curing oven is about 5–15 minutes and the surface temperature is about 280–320° F., preferably about 290–300° F. The curing may be carried out in a convection oven or in an infra-red oven or in a combination of the two.

Corona discharge guns and triboelectric guns are useful in the method of this invention. The guns may be stationary in the spray booth or a Waggler gun mover may be used. The distance from the nozzle of the electrostatic gun to the workpiece is typically from about 6 to 12 inches, preferably about 10 inches. KV settings on the guns of 60–70 are favored. The relative humidity of the spray booth is preferably from about 25 to about 65% and the temperature is preferably 75±10° F. Climate controlled storage is important for low temperature coating powders which are particularly useful in the coating of heat-sensitive substrates. The temperature of the coating powder before spraying is preferably about 80–90° F.

Preparation of the workpiece for coating is important. All show edges and corners should be free from porosity, machining marks and fiber raise. Smooth polish/burnish sanding with a profile edge sander minimizes such problems. Faces should be free from defects and excessive fiber raise. Sanding with progressively finer grits, e.g., from 120 to 400, will diminish problems during coating. Sanding of curvilinear surfaces may be done with CNC routers. Wide belt sanders are useful for flat sanding.

Powder coatings are relatively thick, i.e., typically being between about 3 and about 10 mils thick (75 to 250 microns) at edges and corners as well as in the field. One of the necessary properties for the formation of a smooth film from a coating powder is a high melt flow so that the fused resin flows easily across the surface of the substrate. When the coating powder is thermosetting, a fast gel time (i.e., from about 5 to about 125 seconds at 400° F.) is important. The size and shape of the powder particles also affect the continuity, smoothness, and gloss of thermoset films as well as the electrocoatability of the powder. Low temperature coating powders for heat-sensitive substrates such as wood and plastic are typically fused and cured at temperatures between about 200 and about 350° F. (between about 93 and about 177° C.). All types of such low temperature curable coating powder, are useful in the method of this invention regardless of resin chemistries as long as they meet the melt flow and gel time requirements. Thermoplastic coating powders are applied electrostatically to a substrate, preferably pre-heated, and then, if necessary, heated further to fuse the powder into a uniform continuous coating. Thermosettable (i.e., curable) coating powders are applied electrostatically to a substrate, likewise preferably pre-heated, and subsequently heated to fuse and cure the coating powder into a continuous coating. Such cure may be by heat, UV-light, or a combination of heat and UV light.

ASTM Specification D-3451 defines a procedure for measuring gel time in which a small quantity of powder is dropped onto a hot plate at a given temperature, e.g. 205° C. (400° F.) and stroked with a tongue depressor until continuous and readily breakable filaments are formed when the depressor is lifted from the sample. The elapsed time for this to occur is measured in seconds and is the gel time.

The Hot Plate Melt Flow (HPMF) test is used to measure the melt flows reported herein. In this test a pellet of powder having a diameter of 12.7 mm and 6 mm thick is placed with as little pressure as possible on a hot plate set at 375° F.(190±2° C.) at an inclination angle of 35°. The pellet is allowed to melt and and run down the plate for 5 minutes. The length of the flow is measured with a steel rule to the nearest 0.5 millimeter. The distance from the uppermost position of the pellet to the extreme lower position is considered to be the flow.

A thermosetting coating powder comprising a linear carboxyl group-containing polyester and a glycidyl group-containing acrylic copolymer that is available under the trademark LAMINEER® MA1-1003 and has a gel time of 12–25 seconds at 400° F. and a melt flow of 15–25 mm at 375° F., both of which are suitable for the purposes of this invention.

The heated workpiece may be used to fuse a dual-cure powder before an initial ultra-violet radiation curing stage and to supply at least part of the heat necessary for a thermal curing stage. The powder is fully cured on the surface of the workpiece upon exposure to sufficient heat to melt and flow out the powder into a smooth molten film and activate the thermal initiator and exposure of the molten film to sufficient UV radiation to activate the photoinitiator. A dual cure coating powder composition in solid particulate form having a gel time of about 35–150 seconds at 300° F. and a melt flow at 375° F. of 60–150 mm, suitable for the purposes of this invention comprises:

a) an unsaturated resin selected from unsaturated polyesters, unsaturated polyacrylates, unsaturated polymethacrylates, and mixtures thereof;

b) an optional second co-polymerizable resin crosslinker having a functional group selected from vinyl ether, acrylate, methacrylate, and allyl ester groups, and mixtures thereof;

c) a photoinitiator selected from photolytically activated free radical generating compounds; and d) a thermal initiator selected from thermally activated free radical generating compounds, such as peroxides, azo compounds, and mixtures thereof.

Another coating powder having the required gel time and melt flow for coating a a workpiece according the method of this invention is the two-component, thermosetting powder available under the LAMINEER® trademark and described in U.S. Pat. No. 5,714,206. Said patent describes a powder coating system in which the thermosetting of an extruded mixture of an epoxy resin and (A) a catalyst or (B) an amount of a low temperature curing agent insufficient to cause substantial curing of the resin during extrusion is facilitated by the separate addition of a low temperature curing agent; said extruded mixture and said separately added low temperature curing agent both being in powder form and being blended to form a coating powder.

Another powder suitable for the coating method of this invention is the texture coating powder is described in U.S. Pat. No. 5,721,052 and is available under the LAMINEER® trademark. A continuous grainy textured finish is formed from a composition in particulate form which comprises a blend of an epoxy resin, a catalytic curing agent, a texturing agent, and a flow control agent. The gel time and melt flow of the coating powder composition are 10–15 seconds at 400° F. and 50–100 mm at 375° F., respectively. The composition preferably has a cure time/temperature range of from about 30 seconds at about 350° F. peak substrate temperature down to about 20 minutes at about 225° F. peak substrate temperature.

Still another coating powder composition suitable for the purposes of this invention is described in U.S. Pat. No. 5,686,185. Said composition comprises a blend of: (a) an epoxy resin; (b) a phenolic curing agent for said epoxy resin; and, (c) a cure catalyst in which the stoichiometry of said curing agent to said epoxy resin is provided in an effective amount to provide a flexible, smooth, powder coating. The gel time and melt flow of the coating powder composition are 8–12 seconds at 400° F. and 20–40 mm, respectively.

Yet another coating powder that is suitable for the coating method of this invention is the one component powder available under the trademark LAMINEER®. It is made by extruding a mixture of an epoxy resin having a melt viscosity of from about 200 to about 3000 centipoise at 150° C. and a curing agent which is latent at a temperature of from about 160° F. to about 220° F., cooling the molten mixture, and comminuting it. The epoxy resin has an equivalent weight of from about 350 to about 700. Epoxy resins known as EPN (epoxy phenol novolac) and ECN (epoxy cresol novolac) resins are suitable. The preferred melt viscosity is from about 300 to about 1000 centipoise. The resins have a $T_g$ of from about 35° C. to about 55° C. A friable solid low temperature curing agent such as an epoxy adduct of an aliphatic polyamine is a suitable curing agent for the one component coating powder. The gel time of this powder is preferably about 20–40 seconds at 400° F. and the melt flow is about 80–110 mm at 375° F.

What is claimed is:

1. On a heat-sensitive workpiece having a front side, and a back side, said front side having a field portion and machined edge portions bordering the field portion, a method for forming a continuous coating on said workpiece comprising the steps of preheating the workpiece to achieve a surface temperature of from about 230° to about 260° F., electrostatically spraying a coating powder onto the back side first and allowing the powder to wrap around to coat the machined edge portions and a portion of the field of the front side, then electrostatically spraying a coating powder onto the front side, fusing the powder to form a film, and curing a thermosetting film or cooling a thermoplastic film.

2. In the method of claim 1 wherein the profile of the machined edge portions is step-shaped, having a lower step adjacent the back side and an upper step adjacent the front side, and wherein the coating powder being sprayed onto the back side wraps around to partially coat said lower step and fully coat the upper step.

3. The method of claim 1 wherein the coating powder has a gel time of 5–125 seconds at 400° F.

4. The method of claim 1 wherein the coating powder has a melt flow of 15–150 mm at 375° F.

5. The method of claim 2 wherein the coating powder has a gel time of 5–125 seconds at 400° F.

6. The method of claim 2 wherein the coating powder has a melt flow of 15–150 mm at 375° F.

7. On a heat-sensitive workpiece having a front side and a back side said front side having a field portion and machined edge portions forming the perimeter of the field portion, and a routed groove in said field portion and spaced apart from the perimeter, a method for forming a continuous coating on said workpiece comprising the steps of preheating the workpiece to achieve a surface temperature of from 230° to about 260° F., spraying a coating powder into the groove with an electrostatic spray gun having a pinpoint nozzle, electrostatically spraying a coating powder onto the back side first and allowing the powder to wrap around to coat the machined edge portions and a portion of the field of the front side, then electrostatically spraying a coating powder onto the front side, fusing the powder to form a film, and curing a thermosetting film or cooling a thermoplastic film.

8. The method of claim 7 wherein the coating powder has a gel time of 5–125 seconds at 400° F.

9. The method of claim 7 wherein the coating powder has a melt flow of 15–150 mm at 375° F.

* * * * *